US005597389A

United States Patent [19]

Brown

[11] Patent Number: 5,597,389

[45] Date of Patent: Jan. 28, 1997

[54] DYEING OF POLYKETONE FIBER

[75] Inventor: Houston S. Brown, Houston, Tex.

[73] Assignee: Shell Oil Company, Houston, Tex.

[21] Appl. No.: 19,939

[22] Filed: Feb. 19, 1993

[51] Int. Cl.[6] ..... D06P 3/79; D06P 5/00

[52] U.S. Cl. ..... 8/490; 8/513; 8/922

[58] Field of Search ..... 8/513, 928, 490

[56] References Cited

U.S. PATENT DOCUMENTS

| | | | |
|---|---|---|---|
| H,983 | 11/1991 | Brown et al. | 264/21 |
| 3,068,201 | 12/1962 | Michel | 260/63 |
| 3,096,140 | 7/1963 | Gaetani | 8/673 |
| 3,332,732 | 7/1967 | Karoly | 8/587 |
| 3,409,385 | 11/1968 | Dehn Jr. | 8/679 |
| 4,030,882 | 6/1977 | Blackwell | 8/39 R |
| 4,134,882 | 1/1979 | Hans et al. | 528/3 |
| 4,432,770 | 2/1984 | Hasler et al. | 8/63 |
| 4,626,257 | 12/1986 | Matsuo et al. | 8/63 |
| 4,824,910 | 4/1989 | Lutz | 525/18 |
| 5,045,258 | 9/1991 | van Breen et al. | 264/85 |

FOREIGN PATENT DOCUMENTS

| | | |
|---|---|---|
| 645540 | 7/1962 | Canada . |
| 310171 | 4/1989 | European Pat. Off. . |
| 456306A1 | 11/1991 | European Pat. Off. . |
| WO90/14453 | 11/1990 | WIPO . |

*Primary Examiner*—Margaret Einsmann

[57] ABSTRACT

Fibers, or articles prepared therefrom, of linear alternating polymer of carbon monoxide and at least one ethylenically unsaturated hydrocarbon are effectively dyed by contacting the fibers in aqueous dyebath under mild dyeing conditions in the substantial absence of a dye carrier. The dyed materials are useful in apparel fabrics.

11 Claims, No Drawings

DYEING OF POLYKETONE FIBER

FIELD OF THE INVENTION

This invention relates to a process of dyeing fibers of linear alternating polymers of carbon monoxide and at least one ethylenically unsaturated hydrocarbon, as well as to the dyed fibers.

BACKGROUND OF THE INVENTION

The application of dyes to fibrous objects has taken place since before recorded history. Application of natural dyes to textiles has been industrially important since at least the twelfth century. Much more recently, the discovery of numerous synthetic dyes has expanded the use of dyeing process but the extensive use of synthetic fibers has resulted in a considerable number of complications when dyes are to be applied to such synthetic materials for textile and other applications.

Dyeing describes the impregnation of objects such as paper, textiles and leather with a new color which is usually permanent. The process of dyeing includes dissolution or dispersion of the dye in a liquid medium and subsequent application to the object whose dyeing is desired to attach the dye to the object by chemical or physical means. Water is often preferred as the liquid medium although non-aqueous media have been employed.

The success of the dyeing process is at least in part a function of the chemical nature of the dye as well as the chemical nature of the object to be dyed. Fibers of materials such as cotton, wool and Nylon incorporate functional groups which are hydrophilic in character and give good results when ionic dyes, e.g., acid dyes, are applied. Fibers of other materials such as Rayon (cellulose acetate) or polyester (polyethylene terephthalate) are hydrophobic in character and do not respond well to ionic dyes. Better results are obtained in the dyeing of polyester or other hydrophobic fibers if the dye is of the class of dyes termed disperse dyes. Such dyes are only slightly soluble in water but under the conditions of dyeing are sufficiently soluble to penetrate the fibers to some extent. The dyeing of the fibers of nonionic hydrophobic material is improved, however, through the use of a carrier. The carriers, which are well known and understood in the art, are frequently aromatic in character and have solubility characteristics similar to the fiber to be dyed and many of the disperse dyes. The carrier is thought to loosen interpolymer bonds of the fiber and promote dispersion of the dye into the hydrophobic polymer. However, the use of a carrier creates other difficulties in that the carrier is only slightly soluble in aqueous medium and emulsifiers must be used to disperse the carrier in the dyebath.

The use of a carrier during the dyeing of polyester or other hydrophobic polymers is avoided on occasion if vigorous dyeing conditions are employed. Such conditions typically include a temperature at least substantially above 100° C. and superatmospheric pressures to permit the use of these temperatures with an aqueous medium. It is at least in part because of these considerations that the dyeing of fibers of nonionic, hydrophobic polymers is relatively difficult and/or expensive to effect. For an extensive discussion of dyes, and the dyeing process see Kirk-Othmer, Encyclopedia of Chemical Technology, Third Edition, Volume 8, John Wiley & Sons, 1979, pages 151–158, 280–297, 304–308 and 323–324. Some physical procedures have been used to facilitate polyester fiber dyeing. Frankfort, U.S. Pat. No. 4,134,882, discloses better dyeing with fibers spun with extremely high withdrawal speeds. Hasler et al; U.S. Pat. No. 4,432,770, obtain better results with combination of two or more dyes.

An additional class of polymers which are nonionic and hydrophobic is the broad class of polymers of carbon monoxide and at least one ethylenically unsaturated hydrocarbon. Early examples of such polymers are the carbon monoxide/ethylene copolymers described by Michel et al; U.S. Pat. No. 3,068,201, which are produced by free-radical polymerization. These polymers, which are random and of variable proportions of carbon monoxide and ethylene units, are said to have low dye-receptivity. The object of Michel et al. is to chemically modify the carbon monoxide/ethylene copolymers to improve certain properties of the polymer including dye receptivity.

More recently the class of linear alternating polymers of carbon monoxide and at least one ethylenically unsaturated hydrocarbon has become well known in the art. Such polymers, also termed polyketones or polyketone polymers, are represented by the repeating formula $$-\overset{\overset{\displaystyle O}{\|}}{C}-A- \qquad (I)$$

wherein A independently is a moiety of at least one ethylenically unsaturated hydrocarbon polymerized through the ethylenic unsaturation thereof. Such polyketone polymers would be expected to receive dye only with difficulty because of the nonionic and hydrophobic character of the polymers. Lutz, U.S. Pat. No. 4,824,910 describes blends of such polyketone polymer with minor proportions of poly-(vinylpyridine). Lutz states that incorporation of the vinylpyridine polymer into the polyketone matrix should in effect increase the dye-reactivity of the polyketone polymer. The information of the blend serves to provide a material which will have more hydrophillic character and thus increased dye-receptivity.

It would be of advantage to have a process for the dyeing of fibers of linear alternating polymer of carbon monoxide and at least one ethylenically unsaturated hydrocarbon without the need for the provision of a carrier or the use of vigorous dyeing conditions, but which provides dyed polyketone polymer fibers of good properties.

SUMMARY OF THE INVENTION

The present invention provides a process for the dyeing of fibers of linear alternating polymer of carbon monoxide and at least one ethylenically unsaturated hydrocarbon, as well as dyed fibers. The process of dyeing polyketone fiber is characterized by relatively mild conditions of temperature and pressure and yet no carrier is required. The dyed fiber is characterized by a high depth of dye and good properties of fade and wash resistance.

DESCRIPTION OF THE INVENTION

The polyketone polymer whose fibers are dyed according to the invention is a linear alternating polymer of carbon monoxide and at least one ethylenically unsaturated hydrocarbon. Suitable ethylenically unsaturated hydrocarbons for use as precursor of the polyketone polymer have up to 20 carbon atoms inclusive, preferably up to 10 carbon atoms inclusive. A preferred class of polymers employs hydrocarbon precursors which are e-olefins such as ethylene, propylene, isobutylene, 1-butene, styrene, 1-hexene and 1-dodecene. Preferred polyketone copolymers are copolymers of carbon monoxide and ethylene and preferred polyketone terpolymers are terpolymers of carbon monoxide, ethylene and propylene.

The preferred polyketone polymers are therefore represented by the repeating units of the formula $$-[CO-(C_2H_4)]_x-CO-(G)]_y- \quad \text{(II)}$$

wherein G is a moiety of an α-olefin of at least 3 carbon atoms polymerized through the ethylenic unsaturation thereof and the ratio of y:x is no more than about 0.5. Particularly preferred polymers are those of the above formula II wherein G is a moiety of propylene and further preferred are the polymers in which the ratio of y:x is from about 0.01 to about 0.1. When y is zero, the polyketone polymer is a copolymer of carbon monoxide and ethylene. When y is other than zero the polymer is a terpolymer and the $-[CO-(C_2H_4)]-$ moieties and the $-CO-(G)-$ -moietles are found randomly throughout the polymer chain.

The polymers are produced by now well-known methods which generally include contacting the carbon monoxide and ethylenically unsaturated hydrocarbon under polymerization conditions in the presence of a liquid reaction diluent and a catalyst composition formed from a compound of palladium, an anion of a strong non-hydrohalogenic acid and a bidentate ligand of phosphorus. Methanol is a preferred reaction diluent and a preferred catalyst composition is formed from palladium acetate, the anion of trifluoroacetic acid or p-toluenesulfonic acid, and 1,3-bis(diphenylphosphino)propane or 1,3-bis[di(2-methoxyphenyl)phosphine]propane. Typical polyerization conditions include a reaction temperature from about 50° C. to about 135° C. Useful reaction pressures are from about 5 bar to about 100 bar. The polymer product is typically obtained as a suspension in the reaction diluent and is recovered by conventional methods such as filtration or decantation. The polymers are characterized by a melting point from about 175° C. to about 300° C. and a limiting viscosity number (LVN), as measured in a standard capillary viscosity measuring device in metarcresol at 60° C., of from about 0.5 dl/g to about 10 dl/g.

The fibers of the linear alternating polymers are produced from the polymer by conventional methods. In a preferred modification, the fiber is prepared as a continuous filament by a spinning technique as described by van Breen et al., U.S. Pat. No. 5,045,258, incorporated herein by reference. Suitable spun fibers are drawn (stretched) or are undrawn, although the fibers that are spun and then drawn are generally preferred. In an alternate modification, the fibers are produced by melt blown fiber fabrication as illustrated by U.S. Pat. Nos. 2,357,392, 2,483,404, 2,810,426 and 3,689,342.

The polyketone fibers are dyed according to the process of the invention with a disperse dye. The class of disperse dyes is well known and many disperse dyes are commercial. The disperse dyes are compounds of low water solubility and non-ionic. Many disperse dyes are anthraquinone, quinophthalone, acridone or naphthazarine derivatives of other aromatic compounds. The disperse dyes are available to provide a complete shade range for hydrophobic fibers such as the polyketones.

The dyebath employed is an aqueous mixture of a surfactant and the disperse dye with the optional presence of other materials such as an UV absorber. Suitable surfactants include sorbitan fatty acid esters such as sorbitan monostearates, fatty acid esters of sodium sulfosuccinate, salts of alkylbenzenesulfonic acids such as isopropylamine dodecylbenzenesulfonate, long chain linear alkylbenzene sodium sulfonates, condensation products of fatty acids or fatty amines with ethylene oxide and/or propylene oxide, mono- and diglycerides produced from fatty acids or esters, ethoxylated phenols, including alkylphenols, alkali metal salts of fatty acids, ethoxylated alcohols or alcohol sulfates, alcohol or alkane sulfonates, long chain alkanolamines, phosphate esters of long chain alcohols and tertiary amine oxides. The preferred. surfactants are derivatives of alkyl phenols of ethoxylated alkylphenols. The dyebath is prepared by mixing the disperse dye, the surfactant and water. Additional dyebath components may also be present including conventional UV absorbers and materials which adjust the pH of the dyebath to a desired value, which materials, although somewhat dependent upon the particular disperse dye, are well understood in the art. Typically, the pH of the dyebath is adjusted to a pH of from about 4 to about 5 with a weak acid such as acetic acid or an acid buffer such as a mixture of acetic acid and sodium acetate.

The process of dyeing the polyketone fibers comprises immersing the fibers to be dyed in the dyebath under dyeing conditions in the absence of dye carrier. The concentration of the disperse dye in the dyebath will depend in part upon the particular disperse dye but typically a dye concentration of from about 0.1% by weight based on the weight of the goods to be dyed to about 10% by weight based on the weight of the goods to be dyed is employed. Preferred concentrations of dye are from about 0.3% by weight to about 5% by weight on the same basis. Dyebath liquor to goods ratios (by weight) from about 10:1 to about >0:1 are satisfactory.

The dyeing conditions for dyeing the polyketone fibers are mild dyeing conditions. In the dyeing of fibers of Nylon or polyester, for example, it is frequently necessary to raise the temperature of the dyebath substantially above the normal boiling point to enable the dye to penetrate the fibers, and to employ super atmospheric pressure to maintain the dyebath in a liquid sate. In contrast, the dyeing of the polyketone fibers is effected under mild dyeing conditions at substantially atmospheric boil, i.e., in the liquid phase at substantially the normal boiling point of the dyebath at substantially atmospheric pressure. Use of these relatively mild dyeing conditions, i.e., atmospheric boil, provides economy of operation and yet results in even absorption of dye. Under these conditions, the time required for dyeing is relatively short and yet substantially all of the dye in the dyebath is taken up by the fibers to be dyed. Typical dyeing times are usually less than 1 hour and are often from about 20 to about 30 minutes. It is also an advantage of the present process that the dyeing is accomplished in the substantial absence of the dye carrier which is normally required for the dyeing of nonionic, hydrophobic fibers such as polyester.

The form in which the polyketone fibers to be dyed are employed is not material. It is useful to dye fibers as such and then convert the fibers into articles such as clothing as by knitting or weaving. Alternatively, the fibers are converted to an article which is subsequently dyed according to the process of the invention. The dyed fibers, or articles prepared from the dyed fibers, are characterized by good properties such as wash fastness (lack of fade during washing) and light fastness (lack of fade when exposed to light). The light fastness of the fibers is improved, however, when a UV absorber is included within the dyebath. The dyed fibers are most useful in applications such as dyed apparel fabrics where exposure to continuous UV light is minimized.

The invention is further illustrated by the following Illustrative Embodiments and comparisons (not of the invention) which should not be regarded as limiting.

ILLUSTRATIVE EMBODIMENT I

Bright (no titanium dioxide delusterant) continuous filament yarns of similar denier (approximately 150–200 denier per fiber bundle) were prepared from conventional Dacron® Polyester, Antron® Nylon 6,6 and a linear alternating terpolymer of carbon monoxide, ethylene and propylene (polyketone terpolymer). Each yarn was knit into stocking tubes on a Lawson-Hemphill FAK laboratory knitting machine. Samples of each knit material were dyed with each of 13 commercially available disperse dyes. Dyeings were at two depths, i.e., 0.5% by weight and 4% by weight based on original weight of the goods (o.w.g.), and with or without an UV absorber.

The dyeing procedure involved the preparation of an aqueous dyebath with the appropriate dye, UV absorber where applicable, and a 2% by weight solution of acetic acid and TRITON X-100 (0.5% by weight) as auxiliary chemicals. When employed, the UV absorber was TINUVIN 326 Paste, a benzotriazole marketed by Ciba-Geigy, at levels of 1% o.w.g. and 2% o.w.g. Each dyebath was made up at 130° F. with a liquor to goods weight ratio of 40:1. The goods were placed in the bath and the bath temperature was raised to boil at a rate of about 3° F. per minute. The dyebath was maintained at boil for 40 minutes. The goods were then removed, rinsed, washed in a 0.5% by weight aqueous solution of TRITON K-100 for 10 minutes and then rinsed The knit goods were then dried in a hot-air oven at 220° F.

Each of the dyeings was exposed in an Atlas Fade-O-Meter and examined after 20, 40 and 80 hours. The high-fastness of the dyed goods was numerically evaluated only after any first apparent change of shade (break) using the grey scale cards available from the American Association of Textile Chemists and Colorists (ISO Standard R105/1, Pt. 2).

The lightfastness test results are shown in Table I for dyeings at the 0.5% o.w.g. level of dye and in Table II for the 4% o.w.g. level. The numerical value rates the break or lack thereof with 5 representing no break, 4–5 representing a minimal change of shade and lower numbers representing progressively greater breaks. Two different sources of Yellow 42 disperse dye were tested as a control.

TABLE I

| Disperse Dye, Color Index Name | UV Absorb. | Polyketone Terpolymer Hrs/Rating | Nylon 6,6 Hrs/Rating |
|---|---|---|---|
| Yellow 42 | No | 80, 4–5 | 80, 4–5 |
| | Yes | 80, 4–5 | 80, 4–5 |
| Yellow 42 | No | 80, 4–5 | 80, 4–5 |
| | Yes | 80, 4–5 | 80, 4–5 |
| Red 60 | No | 20, 4–5 | 80, 5 |
| | Yes | 40, 4–5 | 80, 5 |
| Red 86 | No | 40, 3 | 80, 5 |
| | Yes | 40, 4 | 80, 5 |
| Red 263 | No | 20, 3–4 | 80, 5 |
| | Yes | 20, 4 | 80, 4 |
| Red 274 | No | 40, 4 | 80, 4 |
| | Yes | 80, 2–3 | 80, 4–5 |
| Red 302 | No | 20, 3 | 80, 5 |
| | Yes | 20, 4–5 | 80, 5 |
| Violet 57 | No | 20, 4 | 20, 4–5 |
| | Yes | 40, 4–5 | 40, 4–5 |
| Blue 56 | No | 40, 4 | 80, 4–5 |
| | Yes | 40, 4 | 80, 4–5 |
| Blue 60 | No | 40, 4 | 20, 3–4 |
| | Yes | 40, 4 | 20, 4 |
| Blue 73 | No | 80, 3–4 | 80, 5 |
| | Yes | 80, 3–4 | 80, 5 |
| Blue 77 | No | 20, 4 | 20, 4–5 |
| | Yes | 20, 4–5 | 20, 4–5 |

TABLE I-continued

| Disperse Dye, Color Index Name | UV Absorb. | Polyketone Terpolymer Hrs/Rating | Nylon 6,6 Hrs/Rating |
|---|---|---|---|
| Blue 79 | No | 20, 1–2 | 20, 1 |
| | Yes | 20, 2–3 | 20, 1 |

TABLE II

| Disperse Dye, Color Index Name | UV Absorb. | Polyketone Terpolymer Hrs/Rating | Nylon 6,6 Hrs/Rating |
|---|---|---|---|
| Yellow 42 | No | 80, 4 | 80, 4–5 |
| | Yes | 80, 4 | 80, 4–5 |
| Yellow 42 | No | 80, 4–5 | 80, 4–5 |
| | Yes | 80, 4–5 | 80, 4–5 |
| Red 60 | No | 80, 3–4 | 80, 5 |
| | Yes | 80, 4–5 | 80, 5 |
| Red 86 | No | 40, 4 | 80, 5 |
| | Yes | 80, 4 | 80, 5 |
| Red 263 | No | 20, 3–4 | 80, 5 |
| | Yes | 40, 4 | 80, 5 |
| Red 274 | No | 40, 4 | 80, 4–5 |
| | Yes | 80, 2 | 80, 5 |
| Red 302 | No | 80, 4–5 | 80, 5 |
| | Yes | 80, 4–5 | 80, 5 |
| Violet 57 | No | 40, 4 | 40, 4–5 |
| | Yes | 40, 4–5 | 40, 4–5 |
| Blue 56 | No | 40, 3–4 | 80, 4–5 |
| | Yes | 80, 4 | 80, 4–5 |
| Blue 60 | No | 20, 4–5 | 20, 3–4 |
| | Yes | 40, 4–5 | 20, 4 |
| Blue 73 | No | 80, 4–5 | 80, 5 |
| | Yes | 80, 4–5 | 80, 5 |
| Blue 77 | No | 40, 4 | 20, 4–5 |
| | Yes | 40, 4–5 | 40, 4–5 |
| Blue 79 | No | 40, 3–4 | 20, 1 |
| | Yes | 40, 3–4 | 20, 1 |

In the above dyeings, the polyketone terpolymer was the easiest to dye and boil at atmospheric pressure and the shades were almost invariably heavier for the polyketone tarpolymer than for the Nylon under the conditions tested. The demonstrated lightfastness of the polyketone tarpolymer was deemed adequate for applications in dyed apparel fabrics.

ILLUSTRATIVE EMBODIMENT II

Skeins of spun fiber were produced from a typical Nylon, a typical polyester and from drawn and non-drawn fibers of linear alternating tarpolymers of carbon monoxide, ethylene and propylene (polyketone tarpolymer). The dyeing procedure for Nylon and polyketone tarpolymer comprised making up the dyeing mixture of disperse dye (0.5% o.w.g. and 2% o.w.g.) in water, introducing the fiber to be dyed, raising the temperature of the dyebath to boiling and maintaining the bath at atmospheric boil for 20–30 minutes. For polyester, the bath additionally contained 10% o.w.g. of biphenyl, a conventional carrier. In each case, the dyebath was almost completely exhausted of dye. The nine disperse dyes tested were the following:

| | |
|---|---|
| 1. Foron Yellow E3G | 6. Foron Rubine S-RBLS |
| 2. Foron Yellow SE-SCW | 7. Foron Blue E-RR |
| 3. Foron Yellow S-6GL | 8. Foron Blue S-BGL |
| 4. Foron Red E-2LB | 9. Foron Navy S-2GBL |
| 5. Foron Red SE-ST | |

In the evaluation of these dyes the E dyes are easy to apply and level well, the SE dyes are moderate in both respects and S dyes are difficult to apply and level. The dyed samples were removed from the dyebath, rinsed, washed and dried.

Each dyed sample was then washed at 120° F. in the presence of a white Nylon fabric. After washing, the stains on the white fabric were evaluated on a scale of 1–5 where 5 represents no staining and 1 represents severe staining, The results are shown in Table III.

TABLE III

| Dye | % Dye | Polyketone Terpolymer | Drawn Polyketone Terpolymer | Nylon | Poly-ester |
|---|---|---|---|---|---|
| 1 | 0.5 | 3 | — | 4–5 | — |
| | 2 | 3 | 3 | 3 | 4–5 |
| 2 | 0.5 | 4 | 4–5 | 4–5 | 5 |
| | 2 | 3–4 | — | 4 | — |
| 3 | 0.5 | 3–4 | — | 3–4 | — |
| | 2 | 3–4 | — | 4–5 | — |
| 4 | 0.5 | 2–3 | — | 3 | — |
| | 2 | 1–2 | — | 4 | — |
| 5 | 0.5 | 3 | — | 4 | — |
| | 2 | 2–3 | 3–4 | 3–4 | 4–5 |
| 6 | 0.5 | 2–3 | 4 | 4 | 4–5 |
| | 2 | 2 | — | 2.3 | — |
| 7 | 0.5 | 3–4 | 2–3 | 2–3 | 4 |
| | 2 | 1–2 | — | 2 | — |
| 8 | 0.5 | 1–2 | — | 2–3 | — |
| | 2 | 1–2 | — | 2 | — |
| 9 | 0.5 | 1–2 | — | 4–5 | — |
| | 2 | 2–3 | 3–4 | 4–5 | 4–5 |

Other samples of dyed skeins were exposed to a carbon-arc Fade-O-Meter for 40 hours and evaluated for lightfastness by the procedure described in Illustrative Embodiment I. The results of the tests are shown in Table IV.

TABLE IV

| Dye | % Dye | Polyketone Terpolymer | Drawn Polyketone Terpolymer | Nylon | Poly-ester |
|---|---|---|---|---|---|
| 1 | 0.5 | 4–5 | — | 5 | — |
| | 2 | 5 | 5 | 5 | 5 |
| 2 | 0.5 | 5 | 5 | 5 | 5 |
| | 2 | 5 | — | 5 | — |
| 3 | 0.5 | 5 | — | 5 | — |
| | 2 | 5 | — | 5 | — |
| 4 | 0.5 | 3–4 | — | 4–5 | — |
| | 2 | 5 | — | 5 | — |
| 5 | 0.5 | 1–2 | — | 4–5 | — |
| | 2 | 3 | 4 | 4–5 | 5 |
| 6 | 0.5 | 4 | 4–5 | 4–5 | 5 |

TABLE IV-continued

| Dye | % Dye | Polyketone Terpolymer | Drawn Polyketone Terpolymer | Nylon | Poly-ester |
|---|---|---|---|---|---|
| | 2 | 5 | — | 5 | — |
| 7 | 0.5 | 3–4 | 3–4 | 5 | 5 |
| | 2 | 5 | — | 5 | — |
| 8 | 0.5 | 4 | — | 4–5 | — |
| | 2 | 5 | — | 5 | — |
| 9 | 0.5 | 3 | — | 1 | — |
| | 2 | 5 | 4–5 | 1 | 5 |

What is claimed is:

1. A process for dyeing fiber of linear alternating polymer of carbon monoxide and at least one ethylenically unsaturated hydrocarbon by contacting the fiber in aqueous dyebath consisting essentially of water, disperse dye and surfactant, under mild dyeing conditions.

2. The process of claim 1 wherein the linear alternating polymer is of the repeating formula $$\text{—]—CO—(—}C_2H_4\text{—)—[}_x\text{—]—CO—(—G—)—G—[}_y\text{—}$$

wherein G is a moiety of α-olefin of at least 3 carbon atoms polymerized through the ethylenic unsaturation thereof and the ratio of y:x is no more than about 0.5.

3. The process of claim 2 wherein the fiber is produced by spinning and subsequent drawing.

4. The process of claim 2 wherein y is zero.

5. The process of claim 3 wherein the mild dyeing conditions are those of substantially atmospheric boil.

6. The process of claim 2 wherein the polymer is a terpolymer and G is a moiety of propylene.

7. The process of claim 6 wherein the ratio of y:x is from about 0.01 to about 0.1.

8. The process of claim 7 wherein the mild dyeing conditions are those of substantially atmospheric boil.

9. The process of claim 2 wherein the dyebath additionally contains UV absorber.

10. The dyed fiber product of the process of claim 1.

11. A disperse dye dyed fiber of a polymer represented by the repeating formula $$\text{—]—CO—(—}C_2\text{—}H_4\text{—)—[}_x\text{—]—CO—(—G—)—[}_y\text{—}$$

wherein y is a moiety of propylene polymerized through the ethylenic linkage thereof and the ratio of y:x is from about 0.01 to about 0.1.

* * * * *